US006083556A

United States Patent [19]

Hennen

[11] Patent Number: 6,083,556

[45] Date of Patent: Jul. 4, 2000

[54] METHOD AND APPARATUS FOR CONDITIONING THREAD

[76] Inventor: Donna L. Hennen, P.O. Box 2476, Guerneville, Calif. 95446

[21] Appl. No.: 09/165,573

[22] Filed: Oct. 2, 1998

Related U.S. Application Data

[60] Provisional application No. 60/061,052, Oct. 2, 1997.

[51] Int. Cl.[7] ..... B05D 5/08

[52] U.S. Cl. ..... 427/11; 427/175; 57/295; 28/219

[58] Field of Search ..... 427/175, 11, 2.31, 427/2.29; 57/295, 903; 28/219

[56] References Cited

U.S. PATENT DOCUMENTS 4,523,426 6/1985 Scott et al. ..... 57/295

4,875,348 10/1989 Kinnebrew, II et al. ..... 68/200

4,882,377 11/1989 Sweet et al. ..... 524/267

*Primary Examiner*—Timothy Meeks

*Assistant Examiner*—Kirsten A. Crockford

*Attorney, Agent, or Firm*—Larry D. Johnson

[57] ABSTRACT

A thread conditioner to prevent fraying, tangling and associated problems is made from silicone rubber material, such as a silicone elastomer having a physical form of rubber-crepe. The material can be cut from a bulk quantity, rolled, cut into cubes, pressed, and packaged. The conditioner is applied to one end of a length of thread by pressing the thread into the material and pulling the thread across the material, with enough pressure to embed the thread into the material as it is pulled through so that the thread is coated on all surfaces with the material.

5 Claims, No Drawings

METHOD AND APPARATUS FOR CONDITIONING THREAD

This application claims benefit to Provisional Appl. No. 60/061,052 filed Oct. 2, 1997.

BACKGROUND OF THE INVENTION

1. Field of the Invention

This invention relates generally to sewing, quilting, beading and other crafts, and more specifically to an improved material and method for conditioning the thread that is used in such activities.

2. Description of the Prior Art

Thread problems such as fraying, tangling and knotting are not restricted to beadwork along. It is evident that these problems are a frustrating part of any craft where thread plays an important part. Such activities include quilting, applique, "heirloom" sewing, and macrame as well as basketry, bookbinding and fly tying. Traditionally, thread has been treated with beeswax, but this has proven to be a less than satisfactory material to prevent thread problems, and is prone to stickiness, crumbling and melting.

SUMMARY OF THE INVENTION

The thread conditioner of this invention is made from silicone rubber material such as that manufactured by Dow Corning Corporation as silastic GP-437, a silicone elastomer having a physical form of rubber-crepe and a color of white to off-white. Other silicone rubber or elastomer material may also be used. This silicone rubber material can be cut from a bulk quantity of material, rolled, cut into cubes, pressed, and placed into the appropriate packaging.

The inventive method for use of the conditioner includes the following steps:

1. Provide a quantity of silicone rubber material.
2. Press one end of a length of thread into the silicone rubber material and pull the thread across the material. Use enough pressure to embed the thread into the material as it is pulled through so that it is coated on all surfaces with the material.
3. Pull the thread between your thumb and forefinger, slowly and firmly, to stretch the thread and remove kinks.
4. Pull the thread between your thumb and finger a second time, more quickly than the first time, to create a small static charge which forces the thread tails apart.

DETAILED DESCRIPTION OF A PREFERRED EMBODIMENT

The inventive silicone rubber (silicone elastomer) thread conditioner prevents the tangling, fraying, and knotting problems associated with thread of all types. At the same time, it eliminates many of the drawbacks of beeswax, like thread "drag", stickiness, crumbling and melting.

The inventive thread conditioner may be used on nylon, silk, cotton or polyester thread, leather lacing or raffia. Originally developed for beading, this material is a valuable aid for quilting, applique, heirloom sewing, bookbinding, basketry and other craft activities.

The silicone rubber material binds the thread fibers to prevent fraying. It straightens, strengthens and weatherizes the thread. It adds a thin, even, extremely slick coating to the thread surface that makes it slide through the work with remarkable ease. It produces a small static charge that forces the thread tail away from the main shaft which dramatically reduces the primary cause of tangling.

The silicone rubber material doesn't melt or freeze. It doesn't stick to fabric or needles. It doesn't flake, crumble, or crack. It doesn't make the thread "drag". It doesn't clog up bead holes or needle eyes. It doesn't stain fabric or leave any residue.

It is non-toxic, hypo-allergenic and acid free. It is soft and pliable, but not the least bit sticky. It is as easy to use as beeswax and it is comparably priced. It can be packaged in a small box and it lasts for years and years. The product can be easily removed from its container, but it is preferably used right in the box.

Directions for use of the inventive material may include the following:

1. To open the package, cut along the dotted line on the right side of the label and lift up the lid. Don't cut the other side; it will act as a hinge.
2. Using your thumb or forefinger, press one end of a length of thread into the conditioner and pull it across. Use enough pressure to embed the thread as you pull it through so that it is coated on all surfaces with the conditioner.
3. Now pull the thread between your thumb and forefinger, slowly and firmly, to stretch the thread and remove kinks. Notice how slick and smooth the thread feels.
4. Pull the thread between your finger and thumb aa second time, only this time pull it through quickly. This will cause the creation of a small static charge which forces the thread tails apart, drastically reducing the main cause of thread knots. If you find you have produced too much static, dampen your fingers and run them down the thread. Or, draw the thread over a small piece of a dryer fabric softener sheet.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A method of conditioning a thread for use in craftwork, said method comprising the steps of:

providing a quantity of solid silicone rubber material; and pressing one end of a length of thread into the silicone rubber material to coat the thread with the silicone rubber material.

2. The method for conditioning a thread for use in craftwork of claim 1 further including the step of:

pulling the thread to stretch the thread and remove kinks.

3. The method for conditioning a thread for use in craftwork of claim 2 further including the step of:

pulling the thread a second time to create a small static charge.

4. The method for conditioning a thread for use in craftwork of claim 1 wherein said solid silicone rubber material has sufficient plasticity to be cut, rolled into cubes, pressed, and placed into packaging material.

5. The method for conditioning a thread for use in craftwork of claim 1 wherein said silicone rubber material is a rubber-crepe silicone elastomer.

* * * * *